United States Patent [19]

Goff, Jr. et al.

[11] 4,437,779

[45] Mar. 20, 1984

[54] REPLACEABLE RIBBON CARTRIDGE

[75] Inventors: Willie Goff, Jr.; William M. Jenkins, both of Austin, Tex.

[73] Assignee: International Business Machines Corporation, Armonk, N.Y.

[21] Appl. No.: 335,479

[22] Filed: Dec. 29, 1981

[51] Int. Cl.[3] ..... B41J 31/10

[52] U.S. Cl. ..... 400/208; 400/238

[58] Field of Search ..... 156/502, 506, 159; 242/56 R, 58.1; 400/225, 229, 248, 238, 249, 250, 196.1, 208; 226/91, 92

[56] References Cited

U.S. PATENT DOCUMENTS

| | | | |
|---|---|---|---|
| 880,913 | 3/1908 | Perry | 400/238 |
| 2,276,324 | 3/1942 | Mann | 400/238 |
| 2,425,967 | 8/1947 | Toggenburger | 400/238 |
| 2,438,063 | 3/1948 | Lorenz-Risler | 400/238 |
| 2,842,184 | 7/1958 | Manchester | 156/506 |
| 3,047,121 | 7/1962 | Roggenstein | 400/244 |
| 3,108,675 | 10/1963 | Rooney | 400/238 |
| 3,621,969 | 11/1971 | Gotschewski | 400/225 |
| 3,841,459 | 10/1974 | Buschmann et al. | 400/225 |
| 3,955,779 | 5/1976 | Bielik | 242/56 R |
| 3,990,564 | 11/1976 | Crump et al. | 400/229 |
| 4,046,614 | 9/1977 | Zahn et al. | 156/506 |
| 4,115,013 | 9/1978 | Hedstrom | 400/249 |
| 4,277,187 | 7/1981 | Rello | 400/248 |
| 4,284,364 | 8/1981 | Rello | 400/234 |
| 4,290,704 | 9/1981 | Matthias | 400/248 |
| 4,339,211 | 7/1982 | Alexander et al. | 400/248 |

FOREIGN PATENT DOCUMENTS

| | | | |
|---|---|---|---|
| 275821 | 9/1951 | Switzerland | 400/238 |

OTHER PUBLICATIONS

Dials et al., "Ribbon Feed for Bidirectional Printer" IBM Technical Disclosure Bulletin, vol. 23, No. 4, pp. 1517-1520 9/80.

*Primary Examiner*—William Pieprz

*Attorney, Agent, or Firm*—Andrea P. Bryant

[57] ABSTRACT

There is disclosed a ribbon supply replacing technique for a printer or the like comprising a two ree coaxial ribbon cartridge (2) held stationary in the printer and having positioned adjacent thereto severing stations (40 and 42) for separating the cartridge with its exhausted ribbon supply from that ribbon remaining in the ribbon guide structure (6).

3 Claims, 9 Drawing Figures

REPLACEABLE RIBBON CARTRIDGE

TECHNICAL DATA

This invention relates to improvement in ribbon handling for high speed impact printing. More specifically it relates to a stationary ribbon cartridge which may be replaced without requiring that ribbon be rethreaded in the ribbon path of the printer.

BACKGROUND ART

Over the years there have been great improvements in two specific aspects of inked ribbon handling. The first problem related to minimizing soiling of an operator's hand when changing or threading the ribbon. The second area of improvement was simplifying the threading process itself.

U.S. Pat. No. 3,047,121 to Roggenstein teaches an inked ribbon spool set which includes a combination guard and guide for the ribbon exposed between the two spools so that the set may be inserted without soiling the operator's fingers.

Ribbon structures with non-inked tabs on the ends have been proposed. The tabs such as those disclosed in U.S. Pat. No. 880,913 to Perry have been particularly adapted for threading ease and attachment to takeup and/or supply reels. U.S. Pat. No. 3,108,675 to Rooney discloses a ribbon with clean replacement segments with the further advantage that once an initial ribbon has been properly threaded, there is no need for manually rethreading a replacement ribbon. This is because when one ribbon is exhausted it is disconnected from the non-inked coupling strip leaving it still in the ribbon guide. The fresh ribbon is then spliced thereto.

Ribbon cartridges, too, include a non-inked portion to enable the operator to insert in the ribbon guide system without acquiring inked fingers. Still other ribbon handling systems include a cartridge which may be dropped and locked in place with no threading at all such as the IBM 463 Ribbon used with the IBM 5218 Printer.

Printer technology development has produced higher and higher print speed limits. As such development relates to inked ribbon handling, one result has been that the ribbon supply has been removed from the print element carrier to reduce the weight thereof. The ribbon supply cartridge is then held stationary while only a portion of inked ribbon is encased in a flexible guide which allows the required ribbon segment to be present at the travelling print point defined by the print element as it moves with its carrier. A ribbon handling system having the above described features is disclosed in U.S. Pat. Nos. 4,277,187 to Rello, 4,284,364 to Rello and 4,290,704 to Matthias.

DISCLOSURE OF THE INVENTION

The present invention resides in an improved apparatus and method for replenishing the ribbon supply in a high speed printer or the like. A stationary ribbon supply is provided in a two reel, coaxial cartridge. Connected to the printer frame adjacent the stationary cartridge on either side is a flexible ribbon guide for maintaining the ribbon in operative relation to a print element on a moving carrier.

When the ribbon supply is exhausted, the specially designed ribbon segment extending from the cartridge are severed. The flexible ribbon guide still contains a segment of the old ribbon in the properly threaded position for printing. The old cartridge is removed. A new cartridge with ribbon leaders particularly adapted for splicing with the old ribbon segment remaining in the flexible guide structure is inserted. The operator then manually performs adjustments required to resume printing.

DESCRIPTION OF PREFERRED EMBODIMENT

Figure 1:
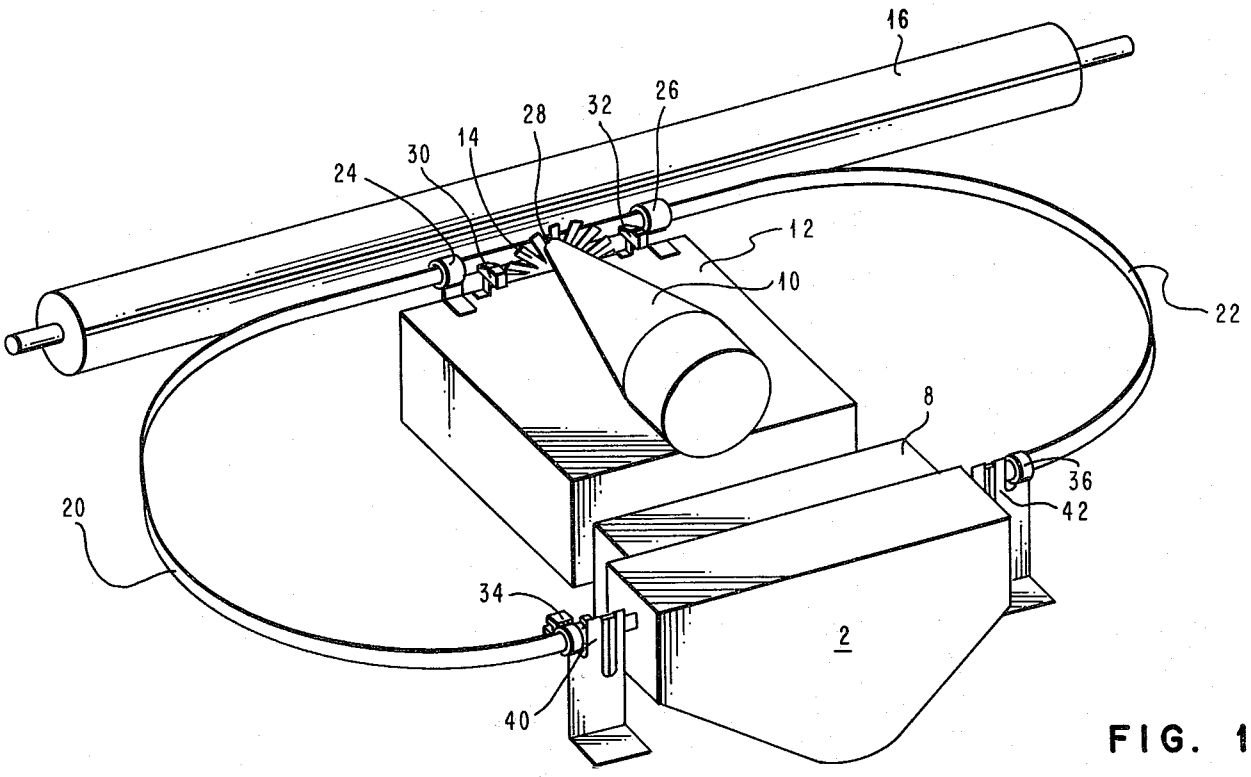
FIG. 1 is a perspective view of a printer with a ribbon cartridge and guide system in accordance with the present invention.

Throughout this description the same reference numerals will be used to refer to the same parts in various figures.

FIG. 1 is a schematic view of a printer including a stationary cartridge with ribbon changing mechanism in accordance with the present invention. Cartridge 2 is a two reel, coaxial ribbon supply and takeup for ribbon 4 encased in flexible housing 6. Ribbon 4 is driven by ribbon drive 8 in order that print element 10 mounted on carrier 12 may impact a print wheel 14 at the appropriate time on a print receiving medium (not shown) on platen 16.

Flexible ribbon guide 6 is in two parts, the supply side 20 and the takeup side 22. Supply side 20 is attached to movable carrier 12 by clamp 24. Similarly takeup side 22 of flexible guide 6 is fixedly attached to carrier 12 by clamp 26.

Between clamps 24 and 26 is a window 28 in flexible ribbon guide 6 which exposes the ribbon 4 at the print station comprised of the print element 10, print wheel 14, and platen 16.

Located near clamp 24 is end of ribbon (EOR) sensor 30 which is connected in a conventional way to a conventional control for halting the print operation when the end of ribbon condition occurs. Another EOR sensor 32 is provided near clamp 26 to be used in the event that multi-pass ribbon requiring bidirectional travel is used.

The end of supply side 20 of flexible ribbon guide 6 terminates at clamp 34 which is attached to the frame (not shown) of the printer. A similar clamp 36 is provided for the corresponding end of takeup side 22 of flexible ribbon guide 6.

Flexible ribbon guide 6 is held stationary to the machine frame adjacent the stationary ribbon cartridge 2. The other ends of flexible ribbon guide 6 move with carrier 12 as it traverses platen 16. Flexible ribbon guide 6 is a permanent structure in a printer adapted to use the ribbon cartridge of the present invention.

Positioned adjacent clamps 34 and 36 are ribbon severing stations 40 and 42 which will be described with reference to FIG. 7.

Figure 2:
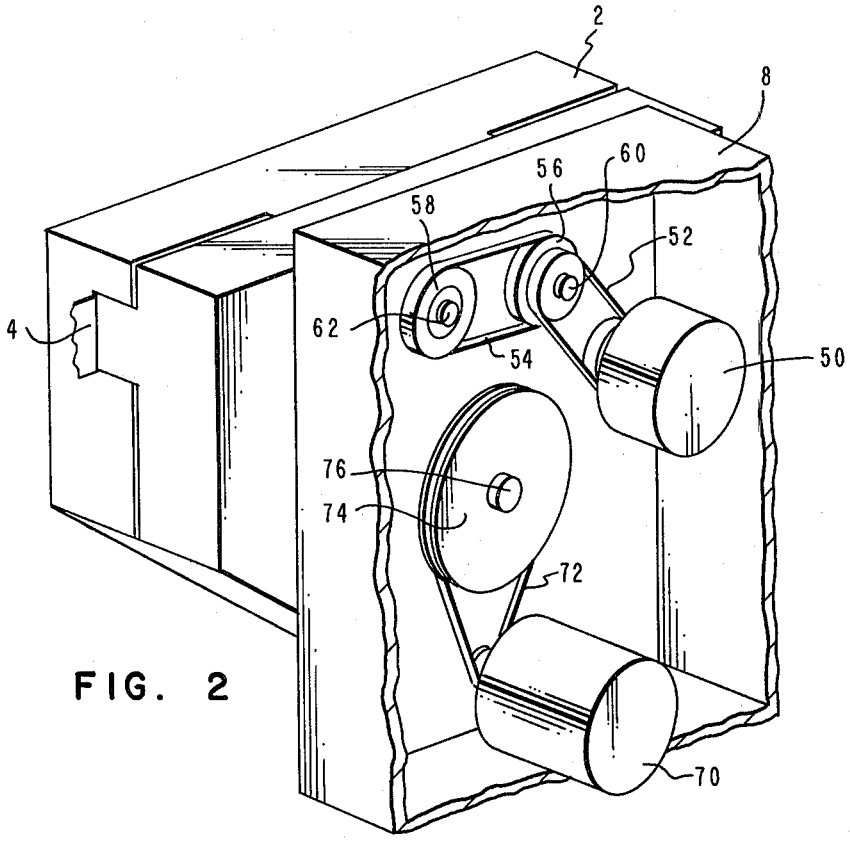
FIG. 2 is a more detailed view of the ribbon drive means, adjacent the ribbon cartridge.

FIG. 2 is a cutaway view of ribbon drive system 8 as seen from the platen 16. Reversible motor 50 is provided for the ribbon feed system. The output of reversible motor 50, through belts 52 and 54, drives pulleys 56 and 58. Each of pulleys 56 and 58 has an overrunning clutch associated therewith. Pulley 56 is drivingly connected to shaft 60 and pulley 58 drives shaft 62. Either of shafts 60 and 62 may be a ribbon feed drive if it is desired to use reversible, i.e., bidirectional, ribbon. Unidirectional motor 70 is the motor for ribbon takeup within cartridge 2. Motor 70 drives shaft 76 through belt 72 on pulley 74.

Figure 3:
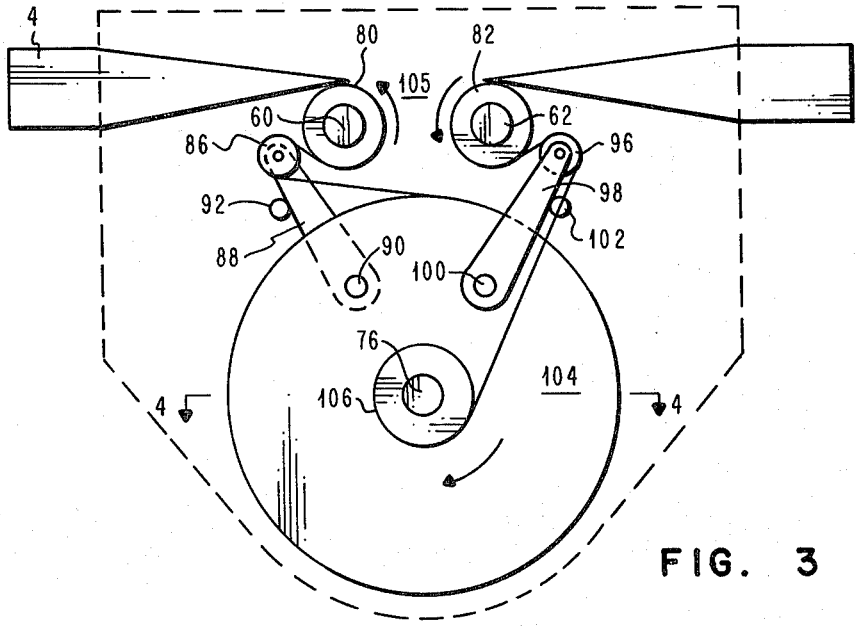
FIG. 3 shows the ribbon path inside the cartridge.

Refer now to FIG. 3 which is a cutaway view of the interior of ribbon cartridge 2 showing the driving connection to the mechanism shown in FIG. 2. In FIG. 3 bidirectional ribbon drive rollers 80 and 82 are driven by shafts 60 and 62, respectively.

Associated with drive roller 80 is free rolling roller 86 which assists in tensioning ribbon 4. Roller 86 also provides a normal load on roller 80 to make a better driving connection. Roller 86 is mounted on pivot arm 88 which can pivot around stud 90. Movement of arm 88 is limited by stop 92 which is a stud integral with rear wall 134 (FIG. 4) of cartridge 2. Similarly associated with drive roller 82 is free rolling roller 96 which is rotatingly connected to pivot arm 98 which pivots about stud 100. Roller 96 aids in the driving connection between roller 82 and ribbon 4 by providing a normal load on roller 82. Movement of pivot arm 98 is limited by stop 102 which is a stud formed integral with rear wall of cartridge 2.

Both ribbon supply 104 and takeup 106 are mounted on a spool hub which is driven by shaft 76. The ribbon supply 104 spool rotates in the direction of arrow 105 as does drive or metering roller 82 in this exemplary illustration where ribbon travel is assumed to be from left to right (FIG. 1). When roller 82 is a drive or metering roller the overriding clutch associated with shaft 60 allows roller 80 to freely rotate counterclockwise as the ribbon takeup supply 106 is driven by shaft 76.

Figure 4:
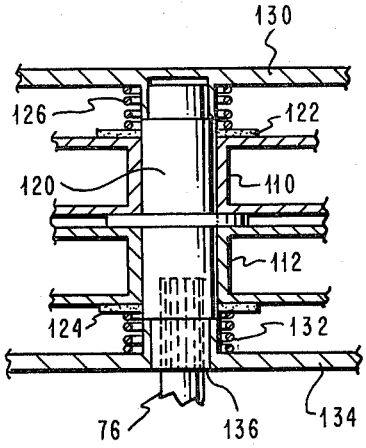
FIG. 4 is a cross-sectional view of the coaxial two reel ribbon cartridge.

Refer now to FIG. 4 which is a sectional view of the coaxial ribbon supply and takeup reels taken along the line 4—4 in FIG. 3. Two flanged ribbon spools 110 and 112 are shown. Spool 110 accommodates the ribbon supply 104 (FIG. 3), spool 112, the ribbon takeup 106 (FIG. 3). Spools 110 and 112 are mounted on spool hub 120. Friction pad 122 is provided adjacent the upper flange of spool 110 and a similar pad 124 is provided for spool 112. Spring 126 surrounds a tenon formed as part of front ribbon cartridge wall 130. Similarly, spring 132 surrounds a tenon formed within cartridge rear wall 134 through which drive shaft 76 fits.

Figure 5:
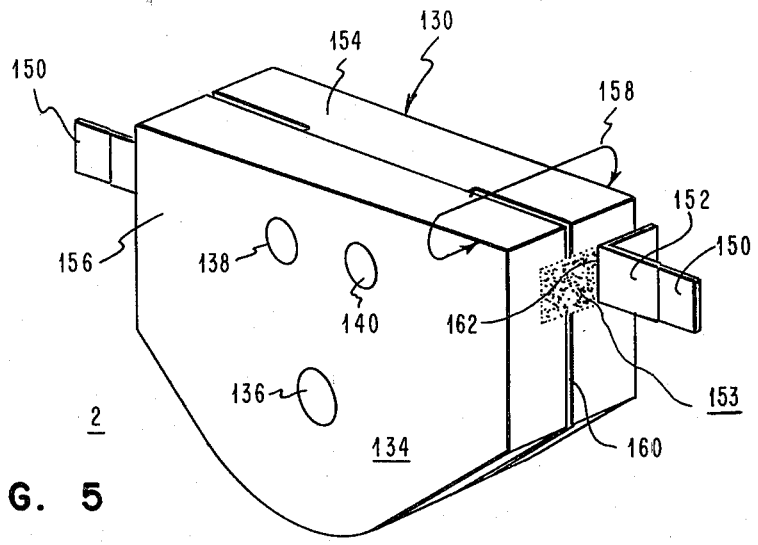
FIG. 5 illustrates a fresh ribbon cartridge with ribbon end tabs.

Refer now to FIG. 5 which is a rear perspective view of coaxial reel ribbon cartridge 2. Front wall 130 cannot be seen. Rear wall 134, however, is provided with holes 136, 138, and 140 for accepting drive shafts. Hole 136 is provided so that shaft 76 may engage and drive the ribbon takeup spool. Shafts 60 and 62 engage the splines in drive rollers 80 and 82 through the holes 138 and 140.

In addition FIG. 5 illustrates the technique used to protect the extending ends of ribbon 4 when the cartridge is new. Cover straps 150 are provided for each ribbon end and are shown partially pulled away to reveal the non-inked extending end 152 of ribbon 4. The non-inked portion of ribbon 152 is, however, covered with an adhesive coating. The area 153 on the cartridge to which leader 152 had been attached prior to pulling away strap 150 is of a much lower bonding strength with respect to that on portion 152 than the adhesive on strap 150.

It is this tacky surface on non-inked portion 152 of the new ribbon which is used in splicing the new ribbon to the old. An operator may grip the two modules of the cartridge housing 154 and 156 as shown by arrow 158. Slot 160 between the sections of housing modules 154 and 156 is wider than slot 162 adjacent ribbon exit walls. Gripping as above described closes slot 162. That will exert sufficient retentive force on the tacky ribbon tab 152 to allow the cover strap 150 to be peeled away once the splice with the ribbon 4 remaining in the flexible ribbon guide 6 has been made.

Figure 6:
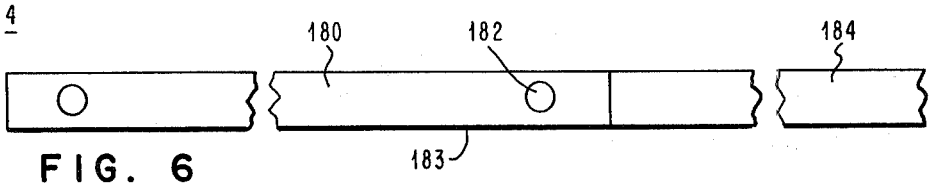
FIG. 6 is a schematic representation of the ribbon and leader including its non-inked segment.

FIG. 6 is a schematic illustration of the ribbon 4 structure. FIG. 6 shows the trailer end leader non-inked portions 180 of ribbon 4. End portion 180 contains apertures 182 which are sized to correspond with ribbon severing means of severing stations 40 and 42 of FIG. 1 and shown in detail in FIG. 7. Apertures 182 may take other shapes providing the distance between the aperture perimeter taken normal to the ribbon edge 183 is compatible with the size and form of notches 202 and 204 (FIG. 7). Segment 184 adjacent segment 180 is the inked ribbon. Segment 180 is preferably formed from paper which does not present the stretching problems of plastic or woven materials and will sever cleanly and easily.

It should be noted that if ribbon cartridge 2 is to be used with a single pass, unidirectional ribbon that the extending end 152 may be of minimal length and directly adjacent inked segment 184 (FIG. 6). Those skilled in the art understand that if ribbon cartridge 2 contains multi-pass ribbon then an arrangement similar to that described in FIG. 7 of segment types 180 must be included at appropriate locations for the particular printer and flexible ribbon guide 6 (FIG. 1) dimensions.

Figure 7:
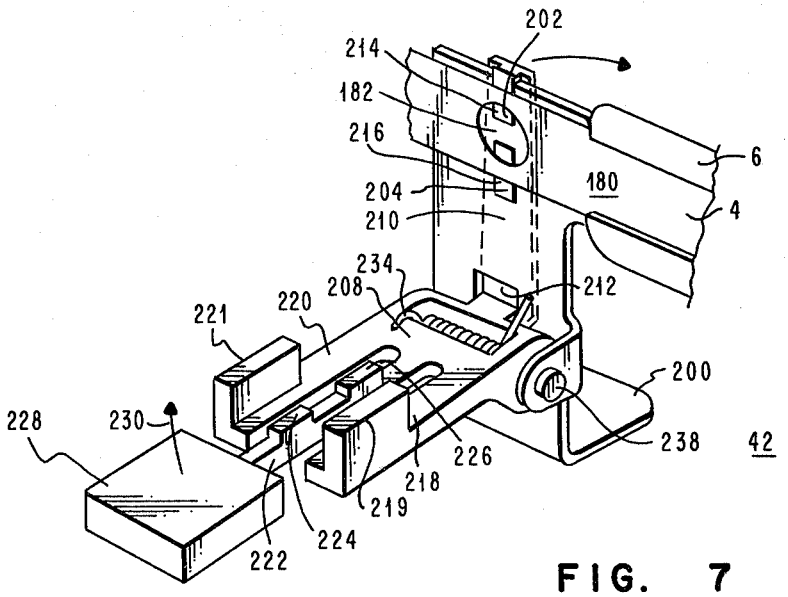
FIG. 7 is a more detailed view of a ribbon severing station.

Referring now to FIG. 7, the severing stations 40 and 42 of FIG. 1 will be described in greater detail. The EOR sensor signal handling sequences will be discussed hereafter. Bracket 200 is fixedly mounted to the frame (not shown) of the printer using the ribbon handling system of the present invention in abutting relation to the flexible ribbon guide 6 so that ribbon 4 is guided to the severing station 40 or 42. Integral with bracket 200 are notches 202 and 204 about which opening 182 in ribbon 4 is centered. Connected to and through bracket 200 is L-shaped member 208. Leg 210 of L-shaped member 208 extends through opening 212 in bracket 200. Leg 210 has projections 214 and 216 which correspond in size and shape to notches 202 and 204 in bracket 200. Projections 214 and 216 fill notches 202 and 204 providing a plane surface over which ribbon 4 may travel.

L-shaped member 208 is formed to include two placer arms 218 and 220 having projections 219 and 221, respectively, which, as will become clear, are provided to cooperate with bracket 200 for supporting ribbon 4 during the severing operation. Flexible arm 222 is positioned between placer arms 218 and 220. Formed on flexible arm 222 are shear faces 224 and 226 which are of the same shape and depth as notches 202 and 204 in bracket 200. Extending from flexible arm 222 is operator finger grip 228 for grasping during the severing operation. To sever ribbon, L-shaped member 208 must be moved in the direction of arrow 230 to overcome the bias of torsion spring 234 which is positioned on stud 238.

Figure 8:
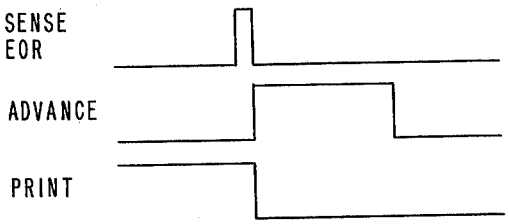
FIG. 8 is a timing chart for unidirectional ribbon cartridge replacement.

FIG. 8 is a timing diagram of the ribbon cartridge replacement sequence to be followed in a printer using the ribbon handling system of the present invention and will be best understood while having reference also to FIGS. 1, 6, and 7. The sequence of FIG. 8 pertains to unidirectional ribbon. The EOR line in FIG. 8 represents a signal generated by either sensor 30 or 32 shown in FIG. 1 depending on the direction of ribbon travel 1. For simplicity only one of the two sensors will be described. Sensor 30 may be of any conventional design and in this illustrated embodiment senses the arrival of the first aperture 182 in segment 180 of ribbon 4. At the same time that the EOR signal is generated the print condition goes down. That is, all printing operations cease. At the same time, ribbon advance is initiated to bring ribbon trailers 180 (FIG. 6) to severing stations 40 and 42 (FIGS. 1 and 2).

It should be noted that for any given printer application, the ribbon structure may be designed to have a predetermined distance between the first aperture 182 which initiates the EOR signal and a second aperture 182 to allow, upon advancement through flexible ribbon guide 6 the first aperture 182 to reach ribbon severing station 42 and the second to reach station 40 (assuming left to right ribbon travel).

At the end of the advance time the operator manually moves L-shaped member 208 using finger grip 228 to sever ribbon 4. Supplementing the discussion of FIG. 7, movement of finger grip 228 in the direction of arrow 230 takes leg 210 out of engagement with bracket 200 and brings placer arms 218 and 220 projection 219 and 221 to a position in contact with non-inked segment 180 of ribbon 4 against bracket 200. Resilient arm 22 continues in the direction of arrow 230 bringing shear faces 224 and 226 into operative contact with portions of the perimeter of hole 182, no longer backed by leg 210 projections 214 and 216. Once ribbon segment 180 is severed, the operator may release finger grip 228 which allows torsion spring 234 to return L-shaped member 208 to its home position, which brings leg 210 back into supporting position for the splicing operation to follow.

Thereafter the old cartridge is removed, the new cartridge is put in place and squeezed as shown by the arrow 160 in FIG. 5 to grip ribbon 4 as the operator tears off adhesive tab 150. The ribbon 4 is then spliced by applying pressure sufficient to cause non-inked segment 180 of the old ribbon to adhere to tacky surface 152 of the new ribbon leader and manually advanced to restart the print operation.

Figure 9:
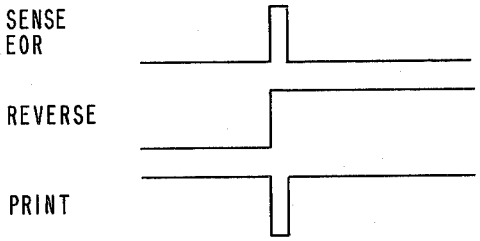
FIG. 9 is a timing chart associated with a bidirectional ribbon cartridge.

FIG. 9 represents the timing of a bidirectional ribbon reversal. After a pass, a non-inked ribbon segment 180 (FIG. 6) arrives at either of sensors 30 and 32. The EOR signal goes up. Ribbon drive reversal is initiated. The print condition is down only during the time it takes to once again present inked ribbon at the print station. After multiple passes of a bidirectional ribbon, at the option of the operator, the printer may be switched to the unidirectional ribbon mode. Thereafter the cartridge is replaced in accordance with the sequence described with reference to FIG. 8.

While the invention has been particularly shown and described with reference to a preferred embodiment, it will be understood by those skilled in the art that changes in form and detail may be made without departing from the spirit and scope of the invention.

We claim:

1. Apparatus for replacing an off the print element carrier ribbon supply cartridge in a printer having a movable print station comprising:

means for maintaining a portion of said ribbon external of said cartridge, said external ribbon being positioned in operative relation to the print station;

a pair of means located on either side of the cartridge for severing said external portion of ribbon from the ribbon remaining in the cartridge;

said means for maintaining comprising two flexible guide means each connected on one end to the printer adjacent one pair of said means for severing, and at the other end to said print element carrier, one on each side thereof, for movement therewith; and means for splicing said external portion of ribbon to ribbon in a replacement cartridge.

2. The apparatus of claim 1 wherein said means for severing includes bracket means connected to the printer, oriented transverse to ribbon travel and located intermediate the ribbon supply cartridge position and said means for maintaining for supporting the ribbon to be severed;

pivotable arm means connected to said bracket means, said pivotable arm means being biased in a position forming substantially a right angle with the plane of ribbon travel, said pivotable arm means being pivotable into contact with the ribbon about an axis parallel to ribbon length and adjacent said bracket means; and said pivotable arm means including punch means for severing the ribbon.

3. Apparatus for maintaining the inked ribbon supply for a printer including a stationary location for ribbon storage and a movable print point comprising:

removable ribbon supply means for storing the greater length of ribbon;

a pair of permanent, flexible ribbon guide means connected to the printer at either side of and near said stationary ribbon storage means and at either side of said print point for conveying a lesser length of ribbon to, past, and from said movable print point;

means adjacent each side of said stationary location for ribbon storage for separating the ribbon in said removable ribbon supply means from that in said flexible ribbon guide means, each of said means for separating additionally including means for supporting the end of ribbon extending from said flexible ribbon guide means during splicing with ribbon extending from a replacement removable ribbon supply.

* * * * *